US006446970B1

(12) United States Patent
Kyrollos

(10) Patent No.: US 6,446,970 B1
(45) Date of Patent: Sep. 10, 2002

(54) STOCK MARKET INVESTMENT GAME

(76) Inventor: Morris Kyrollos, 2 Cambridge Ct., East Brunswick, NJ (US) 08816

( * ) Notice: Subject to any disclaimer, the term of this patent is extended or adjusted under 35 U.S.C. 154(b) by 0 days.

(21) Appl. No.: 09/792,368

(22) Filed: Feb. 23, 2001

(51) Int. Cl.[7] ..... A63F 3/00
(52) U.S. Cl. ..... 273/278; 273/256
(58) Field of Search ..... 273/236, 243, 273/256, 278

(56) References Cited

U.S. PATENT DOCUMENTS

| | | | | | |
|---|---|---|---|---|---|
| 2,174,058 | A | * | 9/1939 | McGennis | |
| 2,691,528 | A | * | 10/1954 | Laidlaw | 273/256 |
| 3,163,423 | A | * | 12/1964 | Jackson | 116/223 |
| 3,539,189 | A | * | 11/1970 | Sylvester | 273/240 |
| 3,980,307 | A | | 9/1976 | Raub | |
| 4,002,342 | A | | 1/1977 | Biggs | |
| 4,046,381 | A | | 9/1977 | Comeaux | |
| 4,312,510 | A | * | 1/1982 | Bodner | 273/256 |
| 4,378,942 | A | * | 4/1983 | Isaac | 273/240 |
| 4,431,195 | A | | 2/1984 | Brand et al. | |
| 4,452,457 | A | * | 6/1984 | Atieh et al. | 273/256 |
| 4,466,515 | A | | 8/1984 | D'Aurora et al. | |
| 4,488,720 | A | | 12/1984 | Cook | |
| 4,856,788 | A | * | 8/1989 | Fischel | 273/256 |
| 5,829,747 | A | | 11/1998 | Nebel | |
| 5,934,674 | A | | 8/1999 | Bukowsky | |
| 6,322,076 | B1 | * | 11/2001 | Fikki | 273/256 |

* cited by examiner

*Primary Examiner*—Benjamin H. Layno
*Assistant Examiner*—Vishu K Mendiratta
(74) *Attorney, Agent, or Firm*—Daniel S. Kirshner

(57) ABSTRACT

A game apparatus for teaching players issues related to investments and the stock market is disclosed. A game board is provided that describes a pathway for player movement thereon. Player movement about the game board is determined according to the roll of a die. The game board includes, playing spaces associated with: 1. players' action of trading commodities; 2. increase or decrease in the value of commodities; 3. ownership of individual companies; 4. extraction of gold from a mine; 5. market rumors; 6. company rumors; market news; 6. company news; 7. stock trading options, and: 8. change in interest rates.

2 Claims, 2 Drawing Sheets

STOCK MARKET INVESTMENT GAME

FIELD OF THE INVENTION

The present invention relates to board games and more specifically it is a board game that teaches the users various concepts related to investment in the stock market, commodities and franchises and methods to maximize their investment.

BACKGROUND OF THE INVENTION

The prior art is replete with board games wherein the winning player is the one who accumulates the greatest wealth through the ups and downs of the stock market. In particular, attention is brought to the following prior art patents:

1. U.S. Pat. No. 3,980,307 issued to Raub on Sep. 14, 1976.
2. U.S. Pat. No. 4,002,342 issued to Biggs on Jan. 11, 1977.
3. U.S. Pat. No. 4,431,195 issued to Brand et al. on Feb. 14, 1984.
4. U.S. Pat. No. 4,466,515 issued to D'Aurora et al. on Aug. 21, 1984.
5. U.S. Pat. No. 5,829,747 issued to Nebel on Nov. 3, 1998
6. U.S. Pat. No. 5,934,674 issued to Bukowsky on Aug. 10, 1999.

A careful reading of the prior art reveals that the prior art is deficient with respect to teaching the players the effects of real world market conditions. In particular, it would be an advantage if the game would teach players the effects of the economy and current news on the stock market and on the stock prices of particular companies. More particularly, it is an object of the present invention for players to learn about the effects of world and market news as well as company news and rumors surrounding them on the player's portfolio.

It is further an objective of the present invention to teach the player how to maximize his or her return on investment in the stock market. In addition, it is an objective of the present invention to teach the player various concepts related to franchises and franchising, as well as trading commodities—particularly gold.

Other objectives, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

A game apparatus for teaching players issues related to investments and the stock market is disclosed. A game board is provided that describes a pathway for player movement thereon. Player movement about the game board is determined according to the roll of a die. The game board includes, playing spaces associated with: 1. players' action of trading commodities; 2. increase or decrease in the value of commodities; 3. ownership of individual companies; 4. extraction of gold from a mine; 5. market rumors; 6. company rumors; market news; 6. company news; 7. stock trading options, and: 8. change in interest rates.

DETAILED DESCRIPTION OF THE INVENTION

Introduction

The object of the stock market investment game of the present invention is to learn various concepts related to investing in the stock market, commodities and franchises. Players strive to become the wealthiest player through trading stocks, commodities and franchises wherein the wealthiest player is the one with the most cash after all of his or her holdings are sold at the end of the game.

Figure 1:
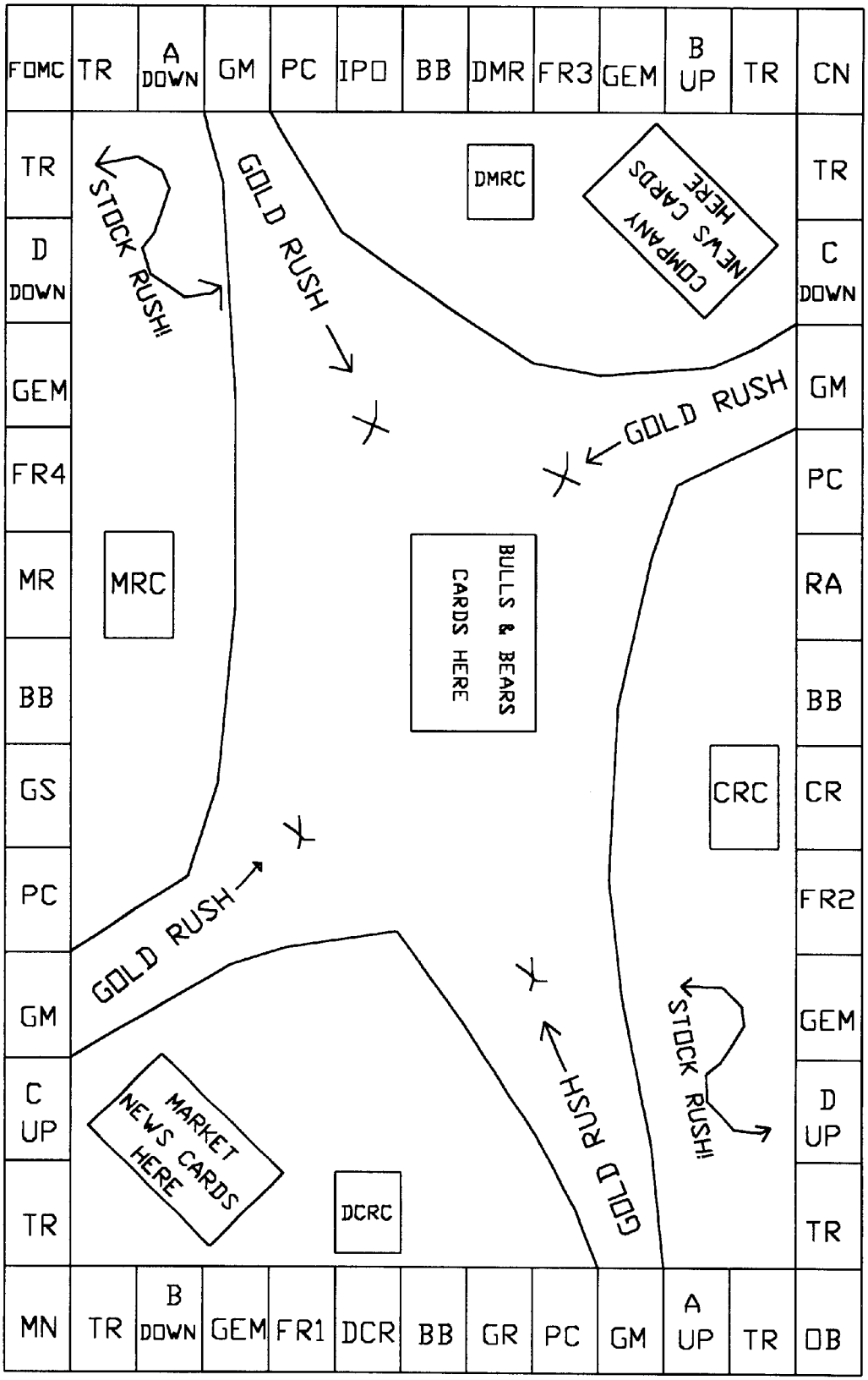
FIG. 1 is a plan view of the game board of the present invention illustrating the various elements of the board involved with the play of a typical game.

The stock market investment game includes the game board 10 depicted in FIG. 1. The game board has a continuous path of spaces around its perimeter, each of the spaces containing written instructions for activity by the player. The majority of the spaces on the game board 10 are self explanatory. However, the present invention stock investment game includes a playing manual to more fully explain the rules of the game. The playing manual includes detailed instructions for every space on the game board which are accompanied by examples when necessary.

Each player is represented by a playing token. The token is placed on the playing board and continues around the spaces of the playing board in accordance with the roll of a die. At each location on the playing board, the player follows the instructions on that space, in accordance with the further instructions of the playing manual. By employing playing strategy and using the knowledge garnered through playing experience, the players attempt to maximize their return on investment thereby acquiring expertise that may be employed in real-world investment trading.

Equipment for Play

The stock investment game of the present invention comprises the following equipment:

1. Game board 10 as depicted in FIG. 1. The game board has a continuous path around its perimeter which is divided into a plurality of playing spaces. Each playing space contains instructions for an action to be performed by the player landing thereon. The game board also includes four converging paths through the central portion of the game board which is denoted Gold Rush. Moreover, card location sites for placement of Company News Cards, Market News Cards, and Bulls and Bears Cards are situated on interior portions of the game board. Finally, locator sites for placement of Market Rumor Card and Dispel Market Rumor Card, Company Rumor Card, and Dispel Company Rumor Card are situated on interior portions of the game board and adjacent to playing squares associated with said Rumors. The perimeter path comprises four sides of the playing board, each side comprising 13 playing squares with a total of 48 playing spaces on the board. A more detailed description of the Game Board follows.

Figure 2:
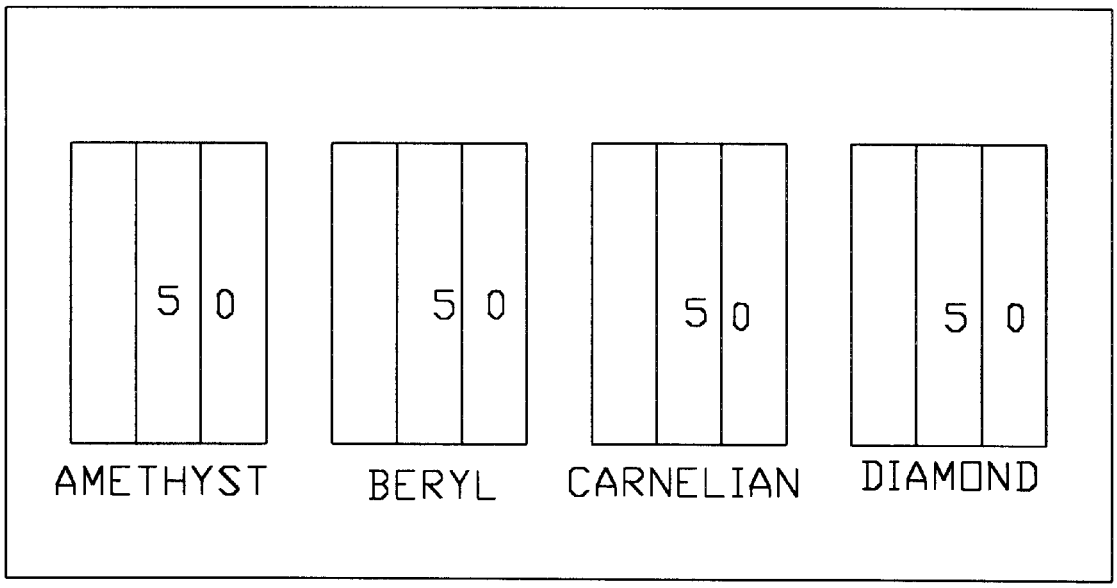
FIG. 2 is a front plan view an embodiment of a mechanical market display of the present invention.

2. Mechanical market display as depicted by in FIG. 2. The mechanical market display includes an indicator of the stock prices for each of the four companies represented in the game. Each stock price is indicated by an individual rotating score-keeper type wheel with a range of stock prices from $0 to $999. It should be understood that although the exemplary embodiment of the game as disclosed herein includes a mechanical market display, it is also contemplated that the game could include an electronic market display wherein circuitry is included to automatically calculate the present stock value of the various companies in accordance with the progress of the game. In addition, the stock prices of the various companies could be monitored manually by utilizing a score pad and pen or pencil.

3. Thirty Six (36) Market News Cards. The market news cards contain news and world events related to investment markets in general which said news is printed on only one side of the Market News Cards which are placed face down on the game board in their allocated position. The Market News Cards affect the stock price of each of the four companies equally. The text of the preferred embodiment Market News Cards is set forth later.

4. Thirty Six (36) Company News Cards. The Company News Cards contain news related to the four individual companies in the game. The news is printed on only one side of the Company News Cards which are placed face down on the game board in their allocated position. The Company News Cards affect the stock price of only the individual company on the card. The text of the preferred embodiment Company News Cards is set forth later.

5. Thirty Six (36) Bulls & Bears Cards, each of which contain instructions related for movement around the board and/or options for trading. The instructions are printed on only one side of the Bulls and Bears Cards which are placed face down on the game board in their allocated position. The text of the Bulls and Bears Cards is set forth later.

6. Market Rumor/Dispel Market Rumor Card which is a single card that contains Market Rumor on one face and Dispel Market Rumor on its opposite face. The Market Rumor Card contains the following instructions:

Step 1: Read top market news card and replace to the top.

Step 2. You may spread rumor for a negotiable fee.

Step 3. You may trade on the rumor.

Step 4. Turn this card over and place on Dispel Market Rumor. First player to affect market below makes rumor widespread. (Top market news card is turned face up).

The Dispel Market Rumor card contains the following instructions:

Step 1: Read top market news card and transfer to bottom.

Step 2. If rumor affected market; reverse effects (# of passes)×roll. If# of passes is not known then 3×roll.

Step 3. You may trade.

Step 4. Turn this card over and return to Market Rumor space.

7. Company Rumor/Dispel Company Rumor Card. which is a single card that contains Company Rumor on one face and Dispel Company Rumor on its opposite face.

The Company Rumor Card contains the following instructions:

Step 1: Read top Company News card and replace to the top.

Step 2. You may spread rumor for a negotiable fee.

Step 3. You may trade on the rumor.

Step 4. Turn this card over and place on Dispel Company Rumor. First player to affect Company below makes rumor widespread. (Top company news card is turned face up).

The Dispel Company Rumor Card Contains the following instructions:

Step 1: Read top Company News Card and transfer to bottom.

Step 2: If rumor affected company; reverse effects→(# of passes)×roll.

If # of passes is not known→3×roll

Step 3: You may trade.

Step 4: Turn this card over and return to Company Rumor Space.

8. Dice: 1 twelve-sided die numbered 1–12. A twelve-sided die is preferred because utilization of a 12 sided die can result in any outcome from 1 to 12 whereas use of two six-sided dice eliminates the possibility of a player rolling a 1.

1 six sided special die (2 sides lower rates, 2 sides raise rates, 2 sides no change.

9. Tokens:

5 Toy tokens

5 Clothes tokens

5 Gear tokens

25 Gold nugget tokens

5 Gold strike tokens

2 Mother lode tokens

20 Player tokens 10. 400 Stock Certificates that total 1 million shares outstanding for each of the 4 traded companies—Amethyst, Beryl, Carnelian and Diamond. For each company, the 100 stock certificates are divided as follows:

50—10 share certificates

25—100 share certificates

7—1,000 share certificates

9—10,000 share certificates

9—100,000 share certificates

11. Stock file box (for easy access and storage of certificates)

12. 4 Franchise Title Cards that represent the following subsidiary companies:

Edible Industries

Funtoys Corporation

Dress for Success Corporation

Computech Incorporated 13. 400 Currency bills of the following denominations:

50—$10 Bills 50—$20 Bills 50—$50 Bills

50—$100 Bills 50—$500 Bills 50—$1000 Bills

50—$10,000 Bills 10—$100,000 Bills 10—$1,000,000 Bills

10—$10,000,000 Bills 10—$100,000,000 Bills

10—$1,000,000,000 Bills

14. Cash file box (for easy access and storage of bills)

15. Short Sale record tables.

Setup

The game is set up in the following manner:

Step 1. One player is selected to be the broker/banker. The broker/banker handles all transactions for the bank, and must keep all of his or her personal holdings away from the bank.

Step 2. The game board is opened and placed on a table.

Step 3. The Market News, Company News, Bulls and Bears, Market Rumor and Company Rumor Cards are placed on the assigned spaces on the game board.

Step 4. The Market Display is placed on the table so that it is clearly visible to all players.

Step 5. The four Franchise Title Cards are placed on the table and in front of the corresponding companies in the Market Display.

Step 6. Each player selects one playing token to represent him or her during the game. The players place their tokens on the Opening Bell space which is in the lower right hand corner of the Playing Board and designated OB on FIG. 1.

Step 7. Each player receives $5,000.00 in cash distributed as follows:

3—$1000.00 bills
3—$500.00 bills
3—$100.00 bills
4—$50.00 bills

Step 8. The price of each stock in the Market Display is set to $50.00 per share (i.e. A=$50, B=$50, C=$50, D=$50)

Playing the Game

The players all begin the game with their tokens on the Opening Bell which is in the lower right hand corner of the game board 10 and designated as OB on FIG. 1. The players travel around the board in a clockwise direction. The object of the game is to be the wealthiest player when the game is over. A time limit may be set whereby the wealthiest player at the end of the time limit is the winner, or in the alternative, play may continue until each player has lost all of his or her assets; the last player remaining wins the game.

Each player is given the opportunity to make at initial trade at the Opening Bell. For instance, one player may buy 20 shares of Amythyst (A) for a cost of $1000 (20×$50) in which case the player pays $1000 to the Broker/Banker and receives 20 shares of Amethyst in return.

Each player rolls the 12 sided die to determine the order of play. The player with the highest roll starts the game. The players move around the Game Board in a clock-wise direction. Each player throws the die and moves their token around the board the number of spaces shown by the die. The player reads the instructions on the space on which he or she lands. When needed, clarification of the instructions can be read in the Game Manual. Once play is complete for a player's turn, the Game Token remains on the space where the player landed until the next play. Game play proceeds to the player to the left. Two or more tokens may rest on the same space at the same time.

There are two groups of trading spaces on the Game Board:

1. Primary Trading Spaces. These are spaces used exclusively for trading and are located adjacent to and to each side of the corner spaces. These are the eight spaces designated as TR on FIG. 1.
2. Secondary Trading Spaces. These spaces provide the opportunity to trade, but only after the instructions for that space are first executed. These eight spaces are the comer spaces on the game board and the rumor spaces which are designated CR, DCR, MR, DMR, OB, MN, FOMC, and CN on the game board, FIG. 1.

The Game Board

A detailed description of the Game Board and the directions for play in association with each playing space is contained in this section of the disclosure. However, complete and comprehensive instructions are contained in the game manual.

Opening Bell. The play starts on the Opening Bell space which is located on the lower right hand comer of the game board and which is designated OB on FIG. 1. All players start with their game tokens on this space. Each time a player's token lands on or passes this space, the player receives $500 from the bank, unless otherwise directed. The Opening Bell is also a secondary trading space.

Primary Trading Spaces. These eight spaces are located adjacent to and to each side of the corners and are designated TR in FIG. 1. These spaces are called "primary trading spaces" because these eight spaces are used exclusively for trading. When a player lands on one of these spaces, he/she may make only one trade unless the player is exercising an option, in which case two trades are permitted. There are three types of trades: 1. Buy. A player may buy any stock he or she wishes at the current market price. For example, if Amethyst (A) is presently trading at $60 per share, a player may buy ten shares for a cost of $600. 2. Sell. A player may sell any company stock that he or she owns at the current market price. 3. Sell Short. A player may sell short any company stock at the current market price.

Gain and Loss spaces. Referring again to FIG. 1, the game board contains 8 spaces that have an effect on the price (either a gain or a loss) of the company stocks in the game. On FIG. 1, these are referenced as follows:

D-UP. This space is D UP Roll for Gain.

C-DOWN. This space is C Down Roll for Loss.

B-UP. This space is B UP Roll for Gain.

A-DOWN. This space is A Down Roll for Loss.

D-DOWN. This space is D Down Roll for Loss.

C-UP. This space is C Up Roll for Gain.

B-DOWN. This space is B Down Roll for Loss

A-UP. This space is A Up Roll for gain.

When a player lands on one of the gain or loss spaces, the player rolls the twelve sided die to determine the gain or loss of the particular stock. For example, if a player lands on the D Down space, the player will roll the die to determine the loss to the price of Diamond (D). The impact on the price of the stock is then reflected on the electronic or mechanical Market Display.

Mining Spaces. The game board includes 8 mining spaces which are designated as follows on FIG. 1 and which are associated with the extraction of minerals (gold) or valuable assets from the earth; and the subsequent sale thereof.

GM. There are four gold mining spaces on the game board. When a player lands here, the player rolls the 12 sided die to dig for gold. If the player rolls an even number (2, 4, 6, 8, 10, 12), that player "finds" the listed number of gold nuggets (1,2,3, or 4) and receives the commensurate gold nugget tokens. However, if the player rolls an odd number (1,3,5,7,9,11) the player pays a $100 mining fee.

GR. This space is called "Gold Rush" and is designed for situations in which more than one player is participating in the game. When any player lands on the Gold Rush space, ALL players advance to the nearest gold mine GM and enter deep into the mine. Each player rolls the 12 sided die and the player with the highest roll strikes gold which is worth 10 gold nuggets. If two or more players roll the same number, they are trapped in a "cave in". When the gold rush is over, the players exit the mine (except those that are trapped) and continue the game from the gold mine space where they originally entered. Trapped players escape using one of the four methods which are outlined in the game manual.

GEM. There are four spaces on the Game Board called Gold Exchange Market spaces designated GEM. These spaces are used only for selling gold (i.e. a player cannot buy gold when he/she lands here.) When a player lands on a GEM space, the player rolls the twelve-sided die to get a current quote on the price of gold. The player may sell his/her gold using this quote. If the player does not like the quote, he/she must wait until another GEM space landing to get another quote. The gold is sold according to the system outlined in the game manual. A player may trade gold with other players at any time. If a condition arises where a player must sell gold to raise cash for a payment, and the player is not on a GEM space, the player may try to sell gold to another player and negotiate for its best price. If no other player is willing to buy gold, then the player must sell gold to the bank at prices fixed by game rules.

Market News. The space in the lower left-hand corner of the game board is the Market News space as designated MN on FIG. 1. This space is coordinated with the Market News Cards which are placed on the game board where it reads "Market News Cards Here". These are cards that reflect news that affect the prices of the stock market in general (i.e. all stocks are affected equally). When a player lands on the Market News space, the player draws a card from the top of the deck of Market News Cards, and reads it aloud. The instructions contained in the Market News Card are followed, and the card is replaced to the bottom of the deck. Finally, if a market rumor exists, then the Dispel Market Rumor Card is turned over and returned to the Market Rumor Space. The Market News Space is also a secondary trading space.

Market Rumor and Dispel Market Rumor. These two spaces (designated as MR and DMR on FIG. 1) are reciprocal and operate in conjunction with the Market Rumor Card. These spaces are associated with rumors that affect the stock market as a whole. At the onset of the game, the Market Rumor Card is placed on the game board on the allocated position which is next to the Market Rumor space and designated MRC on FIG. 1. When a player lands on the Market Rumor space and the Market Rumor Card is on the MRC space, the rumor is considered "new". When the rumor is new, the player must follow the instructions on the Market Rumor Card. If the Market Rumor Card is not on the MRC space, then the rumor is considered to be "old" and becomes known to all players. Consequently, every player that lands on or passes the Market Rumor Space affects the market with their roll. The first player to affect the market must read the top Market News Card aloud and replace it face up to the top of the deck. For instance, if a player rolls a 7 as he/she passes the Market Rumor space, every stock moves up 7 points if the rumor is good, or goes down 7 points if the rumor is bad. Passing players continue to affect the market until the rumor is either confirmed or dispelled. The rumor is confirmed if a player lands on the Market News space MN. The rumor is dispelled if a player lands on Dispel Market Rumor DMR. The player counts the number of times the rumor affects the market. If the rumor is later dispelled, the effects are reversed by multiplying the roll of the die by the same number of times the market was affected.

If a player lands on the Dispel Market Rumor space DMR, and the Dispel Market Rumor Card is in the space designated DMRC, the rumor exists (is old) and the player must follow the instructions on the Dispel Market Rumor Card. Moreover, if the top Market News Card is face up, then the rumor affected the market. The player reverses the effects of the rumor by rolling the numbered die and multiplying the roll by the number of times the market was affected. For instance, if a rumor drove the market up two times, then the effects are reversed by driving the market down by 2 times the roll. If the players lose track of the number of times the market was affected by the rumor, the effects are reversed using three times the roll. These spaces MR and DMR are also secondary trading spaces.

Company News. The Company News space (designated CN on FIG. 1) is located in the upper right-hand corner of the Game Board. The Company News cards which recite news and instructions related to the various companies in the game are placed face down on the Company News Cards space adjacent to the Company News space CN. These cards affect the stock price of each company individually. When a player lands on the Company News space CN, that player takes the top Company News Card and reads it aloud. The instructions on the card are followed and the card is replaced to the bottom of the deck. Finally, if a company rumor exists, then the Dispel Company Rumor Card is turned over and returned to the Company Rumor space. The Company News space is also a secondary trading space.

Company Rumor and Dispel Company Rumor These two spaces (designated as CR and DCR on FIG. 1) are reciprocal and operate in conjunction with the Company Rumor Card. These spaces are associated with rumors that affect each company individually. At the onset of the game, the Company Rumor Card is placed on the game board on the allocated position which is next to the Company Rumor space and designated CRC on FIG. 1. When a player lands on the Company Rumor space and the Company Rumor Card is on the Company Rumor Card space, the rumor is considered "new". When the rumor is new, the player must follow the instructions on the Company Rumor Card. If the Company Rumor Card is not on the Company Rumor Card space, then the rumor is considered to be "old" and becomes known to all players. Consequently, every player that lands on or passes the Company Rumor Space affects the given company with their roll. The first player to affect that company must read the top Company News Card aloud and replace it face up to the top of the deck. For instance, if a player rolls a 5 as he/she passes the Company Rumor space, the given company moves up 5 points if the rumor is good, or goes down 5 points if the rumor is bad. Passing players continue to affect the company until the rumor is either confirmed or dispelled. The rumor is confirmed if a player lands on the Company News space CN. The rumor is dispelled if a player lands on Dispel Company Rumor DCR.

If a player lands on the Dispel Company Rumor space DCR, and the Dispel Company Rumor Card is in the space designated DCRC, the rumor exists (is old) and the player must follow the instructions on the Dispel Company Rumor Card. Moreover, if the top Company News Card is face up, then the rumor affected the company. The player reverses the effects of the rumor by rolling the numbered die and multiplying the roll by the number of times the company was affected. For instance, if a rumor drove the company up four times, then the effects are reversed by driving the company down by four times the roll. If the players lose track of the number of times the company was affected by the rumor, the effects are reversed using three times the roll. CR and DCR spaces are also secondary trading spaces.

Franchises. There are four franchise spaces on the Game Board designated FR1, FR2, FR3 and FR4. These spaces are associated with ownership of the individual companies that are included (Edible, Funtoys, Dress for Success, and Computech). Landing on a Franchise space gives that player an opportunity to purchase a franchise title from the bank, payment for which must be in cash. In addition, the Franchise space contains instructions for purchasing products from the franchiser. When a player purchases a franchise, he/she receives a Franchise Title Card indicating that the player is a franchiser. The value of the franchise is equal to a certain number of shares of the parent company Consequently, the value of the franchise is dependent upon the stock price of the parent company (A, B, C or D). As a result, the franchise title may be traded just like stocks. When the stock of the parent company splits, the equivalent number of shares for the franchise doubles. A player who lands on a franchise space must buy the products listed on the Franchise space, even if the player plans to purchase the franchise. In return, the player receives the appropriate token for the goods purchased (except for groceries). The products one purchases and accumulate by way of tokens may be sold when the player lands on Garage Sale GS which is discussed below.

Garage Sale. When a player lands on the Garage Sale space (designated as GS on the Game Board FIG. 1) he/she may sell some or all of the products (tokens) that player has purchased and accumulated. The products are also sold according to the following system—toys: 2×roll, clothes: 30×roll, Gear: 40×roll.

Bulls and Bears Spaces. There are four spaces called Bulls and Bears spaces, one on each of the four sides of the Board (designated BB on FIG. 1). When a player lands on one of the Bulls and Bears spaces BB, he/she draws a card from the top of the deck of Bulls and Bears cards that are situated in the demarcated spot in the center of the Game Board. The player reads and follows the instructions on the card. Included among the Bulls and Bears Cards are a plurality of option cards. These option cards alternatively give the player call options and put options. Specifically, the call option cards give the player the right, but not the obligation to buy a specific number of shares of a particular stock at a specified price. The put options give the player the right, but not the obligation to sell a specific number of shares of a particular stock at a specified price. Also included are two cards that together form the map to the mother lode which is the richest gold find in the mine. Each mother lode is worth ten gold strikes. Also included are a plurality of cards that dictate movement around the game board.

Federal Open Market Committee Meeting. The Federal Open Market Committee meeting space is located in the upper left hand corner of the game board (designated FOMC on FIG. 1). This space is associated with a governmental change in interest rates which affects the entire market. When a player lands on this space, the player rolls the special die along with the numbered die. The market is affected in the following manner. If the special die rolls "lower rates", the market is up 3× the roll on the numerical die. If the special die rolls "raise rates", the market is down 3× the roll on the numerical die. If the special die rolls "no change", the market is up 1× the roll on the numerical die. The FOMC is also a secondary trading space.

Initial Public Offering. There is one space on the board called the Initial Public Offering Space and is designated as IPO on FIG. 1. This space is associated with actions that a player may take when a privately owned company first begins to sell its stock shares to the public. When a player lands on IPO he/she may elect to do nothing, or may choose to trade. If the player chooses to trade, he/she selects the number of shares to trade with a 1000 share maximum. The player rolls the die to determine the purchase price of the shares, and then rolls again to determine the selling price of the share. If the selling price is higher than the purchase price, the player makes money. If the selling price is lower than the purchase price, then the player loses money. If the prices are identical, the player breaks even.

Pay Cash Spaces. There are four Pay Cash Spaces which are designated as PC on FIG. 1. When a player lands on this space he/she must pay a certain percentage of his or her cash holding to the bank. One space is designated Give to Charity and the player pays 10%. One space is designated Pay Margin Interest and costs the player 10%. One space is designated Pay Income Tax and costs the player 20%. One space is designated Pay Capital Gains Tax and costs the player 20% (the player counts $100 bills and higher only.)

Roll Again Space. When a player lands on the Roll Again Space designated RA on FIG. 1, the player rolls again and moves forward the number of spaces shown on the die.

Contents of the Preferred Embodiment of the Market News Cards, Company News Cards, and Bulls and Bears Cards Included in the present invention board game are indicia of general news on the stock market (Market News Cards), indicia of news with respect to the particular companies forming the basis of the game (Company News Cards) and indicia of options to buy or sell stocks along with a variety of cards that provide special instructions (Bulls and Bears Cards). This section of the disclosure of the invention presents the contents of these cards.

Market News Cards:

1. Allen Greenback appeared before the Federal Open Market Committee (FOMC) yesterday afternoon. The Chairman alluded to signs of possible deflation. Analysts are convinced that he will lower interest rates at the next FOMC meeting.

Market up (2×roll). Roll for gain to all stocks.

2. Yesterday, the President of the U.S. gave his "State of the Union" address. He indicated the economy is strong, and that the U.S. will lead the world economy into the next millennium.

Market up (2×roll). Roll for gain to all stocks.

3. The Producer Price Index (PPI) which measures the cost of goods and services at the wholesale level is lower than expected.

Market up (2×roll). Roll for gain to all stocks.

4. The Consumer Price Index (CPI) which measures the cost of goods and services at the retail level is lower than expected.

Market up (2×roll). Roll for gain to all stocks.

5. The Bureau of Labor statistics released its unemployment data today. The numbers are bullish.

Market up (2×roll). Roll for gain to all stocks.

6. The bond market is up today.

Market up (2×roll). Roll for gain to all stocks.

7. Foreign currencies are very unstable. The dollar is weak. Investors are uneasy and moving to the sidelines.

Market down (2×roll). Roll for loss to all stocks.

8. The stock market is higher today due to positive comments made by Wall Street's leading investment analysts, Lamie and George.

Market up (2×roll). Roll for gain to all stocks.

9. Several companies have reported lower than expected earnings. The downturn continues on Wall Street.

Market down (2×roll). Roll for loss to all stocks.

10. Market gurus Elaine Gardenelly and Eileen Short spoke to news correspondent Bob Pisano. They are extremely bearish. They predict the stock market will drop sixty percent within the next 3 months. Their track record is an excellent contrarian indicator.

Market up (2×roll). Roll for gain to all stocks.

11. Long time bear, Morris Honey, spoke to market expert Ron Insider. Morris predicts that we will enter a bear market this year that will last for three years. However, Ron points out that Morris has been making this prediction for the past 10 years.

Market up (2×roll). Roll for gain to all stocks.

12. Federal Reserve Chairman Allen Greenback was married yesterday morning. He and his lovely wife are spending their honeymoon in Cairo. Most analysts predict many up days in the coming weeks.

Market up (2×roll). Roll for gain to all stocks.

13. The Employment Cost Index (ECI) which measures changes in compensation costs incurred by employers on behalf of their employees dropped 10% this quarter.

Market up (2×roll). Roll for gain to all stocks.

14. Allen Greenback, Federal Reserve Chairman, was awarded the Nobel Prize for economics yesterday for his theory on Global Market Dynamics. Investors feel confident that Allen is at the helm.

Market up (2×roll). Roll for gain to all stocks.

15. The popular portfolio manager, William L. Tender spoke to market watcher Joseph Kernal today. Mr. Tender said he is increasing his cash position to 90%. When Joe asked him why, he exclaimed "cash is my name, and cash is my game!".

Market down (2×roll). Roll for loss to all stocks.

16. News Flash!!

The war overseas has finally ended. Reconstruction has begun.

Market Skyrocket!! All stocks are up 100% (i.e. stock prices are doubled.)

17. Allen Greenback, chairman of the Federal Reserve, spoke before the Federal Open Market Committee (FOMC) yesterday afternoon. He alluded to signs of possible inflation. Analysts believe he will raise interests rates at the next FOMC meeting.

Market down (2×roll). Roll for loss to all stocks.

18. The domestic affairs in the White House has caused the Stock Market to be jittery today. Some analysts are questioning the President's priorities.

Market down (2×roll). Roll for loss to all stocks.

19. The Producer Price Index (PPI), an early inflation indicator, is higher than analyst's expectations.

Market down (2×roll). Roll for loss to all stocks.

20. The Consumer Price Index (CPI), the most widely used indicator of inflation is higher than analysts' expectations.

Market down (2×roll). Roll for loss to all stocks.

21. The Bureau of Labor Statistics released its unemployment data today. The numbers are bearish.

Market down (2×roll). Roll for loss to all stocks.

22. The bond market is down today.

Market down (2×roll). Roll for loss to all stocks.

23. Earnings season begins today. Floor specialists spoke to Opening Bell news correspondent Maria Barticuomo this morning: Maria reports that investors are moving to the sidelines.

Market down (2×roll). Roll for loss to all stocks.

24. News Flash!!

The skirmishes that started overseas last month have developed into a full-scale war. The devastation is enormous.

Market Crash!! All stocks are down 50% (i.e. every stock price is cut in half)

25. News Flash!!

The United States and other industrialized nations are forming an alliance to protect and enforce copyright, patent and trademark laws, particularly in developing countries where infringement runs rampant. All major companies will benefit through billions of dollars in increased revenue!

Market Skyrockets!! All stocks are up 100% (i.e. every stock price is doubled).

26. News Flash!!

International trade restrictions have been lifted. Market Skyrockets!!

All stock prices are up 100% (i.e. every stock price is doubled.)

27. Market forecaster Angela Long believes we have reached a bottom, and the correction is over. She is a well-respected fundamental analyst.

Market up (2×roll). Roll for gain to all stocks.

28. The stock market is higher today due to investors "buying to cover" their short positions.

Market up (2×roll). Roll for gain to all stocks.

29. In the business sector, productivity increased by 2.0% this quarter while production costs dropped by 1.0%.

Market up (2×roll). Roll for gain to all stocks.

30. The U.S. Gross Domestic Product (GDP), which is the total output of goods and services for the country increased by 2.0% for the year. This was in line with expectations and indicates that the economy is growing at a steady pace.

Market up (2×roll). Roll for gain to all stocks.

31. The latest reports show that many top executives of several leading companies are selling more shares of their company stock ("insider selling").

Market down (2×roll). Roll for loss to all stocks.

32. Allen Greenback and his lovely wife, Allena met recently with foreign news correspondent Habeeb Borsa at the Cairo Cafe. When Mr. Greenback was asked whether or not he will serve another term as FOMC chairman, he gave no comment. However, the expression on Allena's face gave the answer—Yes!

Market up (2×roll). Roll for gain to all stocks.

33. News Flash!! An unknown plague is sweeping through major parts of the world and is believed to be headed toward the United States. The casualties are enormous.

Market Crash!! All stocks are down by 50% (i.e. every stock price is cut in half)

34. News Flash!!

The President of the United States has been diagnosed with a rare terminal disease. There is no cure! He may not finish his term in office.

Market Crash!!

All stocks are down 50% (i.e. every stock price is cut in half.)

35. The Employment Cost Index (ECI) which measures changes in compensation costs incurred by employers on behalf of their employees rose 2.0% this quarter.

Market down (2×roll). Roll for loss to all stocks.

36. Perennial bull, Michelle Horn, feels that the correction is over. She says investors should now "charge in" without hesitation!

Market down (2×roll). Roll for loss to all stocks.

Company News Cards

1. Amethyst Corporation (A) reported better than expected quarterly earnings today.

Amethyst up (2×roll). Roll for gain.

2. Today, Copernicus Sisters upgraded Amethyst Corporation (A).

Amethyst up (2×roll). Roll for gain.

3. Amethyst Corporation (A) splits two for one today. Shareholders double their shares.

Stock price is cut in half

Remove this card from game.

Amethyst up (2×roll). Roll for gain.

4. Michael Sapphire, CEO of Amethyst Corporation (A), spoke to scoop specialist David Fiber. Michael said he is acquiring Chalcedony Ind.—a foreign manufacturing company. Chalcedony will enable Amythyst to produce and distribute their products abroad, but it will take at least a year to restructure.

Amethyst down (2×roll). Roll for loss.

5. Beryl Corporation (B) released its quarterly earnings today. They beat analysts' expectations.

Beryl up (2×roll). Roll for gain.

6. Today, Monica and Augustine upgraded Beryl Corporation (B).

Beryl up (2×roll). Roll for gain.

7. Beryl Corporation (B) splits two for one today.

Shareholders double their shares. Stock price is cut in half Remove this card from game.

Beryl up (2×roll). Roll for gain.

8. Owen Topaz, CEO of Beryl Corporation (B), spoke to news correspondent Mark Heinz. Owen said that he is acquiring Azurite Ind.—an overseas production company. Azurite will help Beryl cut production costs by 30%. Since Azurite is heavily in debt, Beryl's earnings will be affected this year.

Beryl down (2×roll). Roll for loss.

9. Carnelian Corporation (C) released higher than expected quarterly earnings today.

Carnelian up (2×roll). Roll for gain.

10. Today, Samson Brothers upgraded Carnelian Corporation (C).

Carnellian up (2×roll). Roll for gain.

11. Carnelian Corporation (C) splits two for one today.

Shareholders double their shares. Stock price is cut in half Remove this card from game.

Carnelian up (2×roll). Roll for gain.

12. Isis Coral, CEO of Carnelian Corporation (C), spoke to news specialist Ted Davinci. Isis said she is acquiring Pearl Corp. Pearl's Manufacturing Procedures will help Carnelian cut its production time by 40%. However, earnings will be diluted this year due to the construction of 7 new plants.

Carnelian down (2×roll). Roll for loss.

13. Diamond Corporation (D) released it quarterly earnings today. They surpassed analysts' expectations.

Diamond up (2×roll). Roll for gain.

14. Today, Francis and Claire upgraded Diamond Corporation (D).

Diamond up (2×roll). Roll for gain.

15. Diamond Corporation (D) splits two for one today.

Shareholders double their shares. Stock price is cut in half.

Remove this card from game.

Diamond up (2×roll). Roll for gain.

16. Ruby Rose, CEO of Diamond Corporation (D) spoke to news specialist, Sue Kerara. Rose said she is acquiring Emerald Enterprises. Emerald's technology will enable Diamond Corporation to regain its dominance in the market place. However, investors are unsure.

Diamond down (2×roll). Roll for loss.

17. Amethyst Corporation (A) released its quarterly earnings report today. They were below expectations.

Amethyst down (2×roll). Roll for loss.

18. Alexander Investments downgraded Amethyst Corporation (A) today.

Amethyst down (2×roll). Roll for loss.

19. Beryl Corporation (B) released lower than expected quarterly earnings today.

Beryl down (2×roll). Roll for loss.

20. Galileo Brothers Downgraded Beryl Corporation (B) today.

Beryl down (2×roll). Roll for loss.

21. Carnelian Corporation (C) released their quarterly earnings report, today. They missed the street's estimates.

Carnelian down (2×roll). Roll for loss.

22. Delilah sisters downgraded Carnelian Corporation (C) today.

Carnelian down (2×roll). Roll for loss.

23. Diamond Corporation (D) released disappointing quarterly earnings today.

Diamond down (2×roll). Roll for loss.

24. Cleopatra Investments downgraded Diamond Corporation (D) today.

Diamond down (2×roll). Roll for loss.

25. News Flash!

Amethyst Corporation (A) issued an earnings warning earlier today—for the quarter and for the rest of the year. Scoop specialist David Fiber spoke to the company's CEO—Michael Sapphire. Mr. Sapphire said revenues have dropped due to increasing competition.

Amethyst Crash! Amethyst is down 50% (i.e. the stock price is cut in half.)

26. News Flash!

Beryl Corporation (B) issued a major product recall. News correspondent Mark Heinz spoke to Owen Topaz—the company's CEO earlier today. Mr. Topaz indicated that several manufacturing plants have to be overhauled and there will be a shortfall in earnings for at least one year.

Beryl Crash! Beryl is down 50% (i.e. the stock price is cut in half)

27. News Flash!

Carnelian Corporation (C) has been convicted of patent infringement. A conference call was held yesterday after the closing bell. The company's CEO Isis Coral spoke to our own Ted Davinci. Mrs. Coral reluctantly said the company will suffer heavy losses for at least two years due to imposed penalties and product suspension.

Carnelian Crash! Carnelian is down 50% (i.e. stock price is cut in half.)

28. News Flash!

Diamond Corporation (D) has been found guilty of violating antitrust laws. The company is appealing the decision. The company's CEO Ruby Rose spoke to our own smiling Sue Kerara; Mrs. Rose said the company continues to have a strong product cycle. She firmly believes Diamond will win the appeal. However, it appears that the market is uncertain.

Diamond Crash! Diamond is down 50% (i.e. stock price is cut in half).

29. News Flash!

Amethyst Corporation (A) reported quarterly earnings that were 300% more than the same quarter a year ago! In the conference call after the bell, CEO Michael Sapphire said he expects the growth rate to continue for at least two years. Every one on Wall Street is left speechless by the report.

Amethyst skyrocket! Amethyst is up 100% (i.e. the stock price is doubled).

30. News Flash!

Beryl Corporation (B) reported quarterly earnings that far exceeded analyst's expectations! Furthermore, the Street was shocked with the growth in revenues—700% over the same quarter last year. Owen Topaz, company CEO, cites the tremendous growth is due to restructuring of the company. He expects the growth rate to continue into next year.

Beryl skyrocket! Beryl is up 100% (i.e. the stock price is doubled).

31. News flash!

Carnelian Corporation (C) reported quarterly earnings that were twice what analysts expected, but the reason Wall Street is jumping for joy is that the Federal government granted Carnelian seven new patents. Isis Coral, its CEO, said Carnelian is in a position to capture 90% of the business market!

Carnelian skyrocket! Carnelian is up 100% (i.e. its stock price is doubled).

32. News flash!

Diamond Corporation (D) has settled with the Federal government in the long-standing anti-trust case against it.

The judge has conceded to keep the company intact in exchange for Diamond paying 7 billion dollars in damages and other measures that ensure fair competition. Wall Street is ecstatic about the outcome! The stock has been in a slump for years and is trading with a p/e ratio far below other companies in the sector.

Diamond skyrocket! Diamond is up 100% (i.e. the stock price is doubled).

33. Amethyst Corporation (A) has developed a new line of products for restaurants. Michael Sapphire, CEO, spoke to scoop specialist David Fiber yesterday after the closing bell. Mr. Sapphire explained that patrons will now be served faster and be entertained as well providing a more pleasant dining experience than ever before.

Amethyst up (2×roll) Roll for gain.

34. Beryl Corporation (B) has developed a new product line for the home. CEO Owen Topaz spoke to our own Mark Heinz yesterday after hours. Mr. Topaz explained that this new line will transform daily chores around the house into fun and enjoyable activities! This begs the question, "can we continue to call them chores?"

Beryl up (2×roll). Roll for gain.

35. Carnelian Corporation (C) has developed a new product line for business. Isis Coral, Company CEO, spoke to our own Ted Davinci after the market closed yesterday. Mrs. Coral explained that this new line will make the working environment more appealing for both clients and staff alike; particularly in inclement weather.

Carnelian up (2×roll) Roll for gain.

36. Diamond Corporation (D) has developed a new line of products for schools. The company CEO Ruby Rose spoke to our own smiling Sue Kerara. Mrs. Rose explained that the new line will enable students to interactively engage with other students around the world allowing them to share information and resources.

Diamond up (2×) roll). Roll for gain.

Bulls and Bears Cards:

1. Amethyst—Call
   Option to buy 20 shares (A) at $50 per share.
   Exercise at any time.
   Must buy only 20 shares.
   Replace this option when done.
2. Beryl—Call
   Option to buy 20 shares (B) at $50 per share.
   Exercise at any time.
   Must buy only 20 shares.
   Replace this option when done.
3. Carnelian—Call
   Option to buy 20 shares (C) at $50 per share.
   Exercise at any time.
   Must buy only 20 shares.
   Replace this option when done.
4. Diamond—Call
   Option to buy 20 shares (D) at $50 per share.
   Exercise at any time.
   Must buy only 20 shares.
   Replace this option when done.
5. Amethyst—Put Option to sell 20 shares (A) at $100 per share.
   Exercise at any time.
   Must sell only 20 shares.
   Replace this option when done.
6. Beryl—Put
   Option to sell 20 shares (B) at $100 per share.
   Exercise at any time.
   Must sell only 20 shares.
   Replace this option when done.
7. Carnelian—Put
   Option to sell 20 shares (C) at $100 per share.
   Exercise at any time.
   Must sell only 20 shares.
   Replace this option when done.
8. Diamond—Put
   Option to sell 20 shares (D) at $100 per share.
   Exercise at any time.
   Must sell only 20 shares.
   Replace this option when done.
9. (Top part of card is one half of "Mother Lode" map)
   Use only in a Gold Rush.
   Find the mother lode with the player that holds the rest of the map.
   Do not participate in the standard gold rush.
   Replace and shuffle when used.
10. (Top part of card is other half of"Mother Lode" map)
   Use only in a Gold Rush.
   Find the mother lode with the player that holds the rest of the map.
   Do not participate in the standard gold rush.
   Replace and shuffle when used.
11. Receive $1000 cash dividend.
12. You inherited an antique vase that fetched $2000 at auction.
13. Injured while mining. Pay $1000 for medical expenses.
14. You have been accused of insider trading. Pay $2000 to Demarco and Lore for preparing your defense.
15. New Years Day. Market Closed. Pay $500 for entertainment. Happy New Year!
16. Pay $1000 to lease the rock wrecker (a mobile vehicle used for mining and rescue.)
   If there is a cave in, use the rock wrecker to free yourself and others trapped with you (free only those that rolled the same as you.)
   Replace when used.
17. Gold Rush!
   All players advance to the nearest gold mine.
   Do not collect salary if you pass the opening bell (applies to all players.)
18. Roll to move
   Even—move ahead 3 spaces.
   Odd—move backward 3 spaces.
19. Roll to move
   Even—move ahead 4 spaces.
   Odd—move backward 4 spaces
20. Advance to Market News.
   Collect salary if you pass the opening bell.
21. Advance to FOMC Meeting.
   Collect salary as you pass the opening bell.
22. Advance to Company News.
   Collect salary if you pass the opening bell.
23. Advance to Give to Charity.
   Collect salary as you pass the opening bell.
24. Advance to Pay Income Tax.
   Do not collect salary if you pass the opening bell.
25. Advance to Pay Margin Interest.
   Do not collect salary if you pass the opening bell.
26. Advance to Pay Capital Gains Tax.
   Do not collect salary if you pass the opening bell.
27. Advance to Market Rumor.
   Do not collect salary if you pass the opening bell.
28. Advance to Company Rumor.
29. Advance to Dispel Market Rumor.
   Do not collect salary if you pass the opening bell.
30. Advance to Dispel Company Rumor.
   Do not collect salary if you pass the opening bell.

31. Advance to the nearest company franchise. (2 spaces ahead.)
32. Advance to IPO.
Do not collect salary if you pass the opening bell.
33. Advance to Garage Sale.
Do not collect salary if you pass the opening bell.
34. Oil Exploration.
Roll to Drill.
Even—Strike oil: get 200×roll.
Odd—Strike water: pay 100×roll for flood damage.
35. Wild Move!
Advance to any space on the board that you wish.
Collect salary if you pass the opening bell.
36. Wild Option!
You may use this card as a call or a put option.
Call: Buy 20 shares of any stock at $50 per share.
Put: Sell 20 shares of any stock at $100 per share.
Exercise at any time.
Must buy or sell only 20 shares.
Replace this option when done.

What is claimed:

1. A game apparatus for a player's enjoyment and for teaching the player concepts related to financial markets comprising:

a plurality of indicia of ownership of stock of companies;

a plurality of indicia of ownership of franchises;

a plurality of indicia of ownership of commodities;

a random number generator;

a game board, said game board defining a pathway for movement thereon comprising a plurality of playing spaces, said game board including a starting playing space from which the player starts;

at least one of said playing spaces on said game board is a trading space, said playing space associated with a player's option to trade said indicia of ownership of stock of companies;

at least one of said playing spaces is a gain and loss space, said gain and loss space associated with a gain or loss in the value of said indicia of ownership of stock of one of said companies, said value of the stock increased or decreased by the action of the player utilizing said random number generator;

at least one of said playing spaces is associated with news that effects the price of said financial market;

at least one of said playing spaces is associated with rumors that effect the price of said financial market, said playing space having an indicator that said rumors are either new or old, at least one of said playing spaces is associated with news that effect the price of said ownership of one of said companies;

at least one of said playing spaces is associated with rumors that effect the price of said ownership of one of said companies said playing spaces having an indicator that said rumors are either new or old;

at least one of said playing spaces is associated with ownership of said franchises;

at least one of said playing spaces is associated with the extraction and valuation of minerals from the earth;

at least one of said playing spaces is associated with buying and selling commodities;

at least one of said playing spaces is associated with a player surrendering cash holdings;

at least one of said playing spaces is an initial public offering space whereupon a player is provided with instructions on purchasing and selling shares of stock utilizing a random number generator to determine a selling price;

at least one of said playing spaces is associated with a mining competition, whereupon a winner of said competitions is determined using said random number generator at least one of said playing spaces is associated with a player's right to buy or sell indicia of ownership of one of said companies; and at least one of said playing spaces is associated with governmental change in interest rates.

2. A method of teaching a user concepts related to the stock market comprising the steps of:

providing a game apparatus for a player's enjoyment that includes a playing space associated with generating rumors that affect the stock market as a whole and a playing space associated with dispelling rumors that effect the stock market as a whole, and a playing space associated with news that affect the stock market as a whole;

providing a game apparatus for a player's enjoyment that includes a playing space associated with generating company rumors that affect a selected company and a playing space associated with dispelling company rumors that effect a selected company, and a playing space associated with news that affect a selected company;

providing an indicator that said rumor is either old or new wherein said indicator is initialized to indicate that the rumor is new and wherein said indicator records the instances that a rumor is generated;

providing instructions for a player to follow when a player lands on said playing space associated with generating rumors and said indicator indicates that the rumor is new, generating a random number that affects the stock market when said indicator indicates said rumor is old, and whereby said rumor is considered confirmed when a player lands on said playing space associated with news that affect the stock market and said rumor is considered dispelled when a player lands on said playing space associated with dispelling rumors that effect the stock market.

* * * * *